US005439170A

United States Patent [19]

Dach

[11] Patent Number: 5,439,170

[45] Date of Patent: Aug. 8, 1995

[54] ILLUMINATED WATER FOUNTAIN

[76] Inventor: Samuel Dach, 22 Havatzelet Hasharon, 44280 Kfar Saba, Israel

[21] Appl. No.: 153,067

[22] Filed: Nov. 17, 1993

[30] Foreign Application Priority Data

Jul. 23, 1993 [IL] Israel ..... 106461

[51] Int. Cl.[6] ..... F21P 7/00

[52] U.S. Cl. ..... 239/18; 239/536

[58] Field of Search ..... 239/18, 536, 17, 20

[56] References Cited

U.S. PATENT DOCUMENTS

| | | | |
|---|---|---|---|
| 1,977,997 | 10/1934 | Patterson | 239/18 |
| 3,165,966 | 1/1965 | Pribyl | 239/18 |
| 4,281,794 | 8/1981 | Dimino | 239/20 |
| 4,305,117 | 12/1981 | Evans | 239/18 |
| 4,376,404 | 3/1983 | Haddad | 239/18 |
| 4,760,961 | 8/1988 | Nagai | 239/536 |
| 5,005,762 | 4/1991 | Cacoub | 239/20 |
| 5,069,387 | 12/1991 | Alba | 239/18 |
| 5,152,210 | 10/1992 | Chen | 239/18 |
| 5,288,018 | 2/1994 | Chikazumi | 239/20 |

FOREIGN PATENT DOCUMENTS

| | | | |
|---|---|---|---|
| 0318410 | 5/1989 | European Pat. Off. | 239/18 |
| 844910 | 7/1981 | U.S.S.R. | 239/18 |
| 0833031 | 11/1982 | U.S.S.R. | 239/18 |
| 1212620 | 2/1986 | U.S.S.R. | 239/18 |
| 1496831 | 7/1989 | U.S.S.R. | 239/18 |

*Primary Examiner*—Andres Kashnikow
*Attorney, Agent, or Firm*—Benjamin J. Barish

[57] ABSTRACT

An illuminated water fountain includes an assembly of water lines each carrying a plurality of water discharge nozzles to produce a pattern of water discharges, and a control system for controlling water valves and an illumination system in accordance with musical sounds.

13 Claims, 2 Drawing Sheets

ILLUMINATED WATER FOUNTAIN

FIELD AND BACKGROUND OF THE INVENTION

The present invention relates to an illuminated water fountain having an assembly of water discharge nozzles, and a system of illumination both of which may be controlled to produce various ornamental effects.

Water fountains in general, and illuminated water fountains in particular, have been known for many years for producing various attractive ornamental effects. An object of the present invention is to provide a new form of control of an illuminated water fountain in order to produce a new type of ornamental effect.

OBJECTS AND BRIEF SUMMARY OF THE INVENTION

According to the present invention, there is provided an illuminated fountain of modular construction, comprising a distribution manifold having a plurality of input ports and a plurality of output ports; a plurality of pumps connected to the input ports of the distribution manifold; and a plurality of modular water line units connected to the output ports of the distribution manifold according to a desired array, each water line unit carrying a plurality of water discharge nozzles to produce a desired pattern of water discharges. Each modular water line unit includes a valve controlling the supply of water to the nozzles of its respective unit to thereby control the pattern of water discharges thereby. The fountain further includes an illumination system for illuminating the pattern of water discharges; a source of musical sounds; and a control system for controlling the water valves and illumination system in accordance with the musical sounds.

According to further features in the preferred embodiment of the invention described below, the control system includes a converter for converting the musical sounds into control signals corresponding to the different frequencies and intensities of the musical sounds, the control system controlling the water valves and illumination system in accordance with the different frequencies and intensities.

According to still further features in the described embodiment, the control system includes a computer controlled by the converter and in turn controlling the water valves and illumination system in accordance with the musical sounds. The control system further includes a preprogrammed element preprogrammed in accordance with a preselected control of the water valves and illumination system, and a holder for receiving the preprogrammed element in a removable manner permitting its removal and replacement by another preprogrammed element for changing the control of the water valves and illumination system in accordance with the musical sounds.

It will thus be seen that an illuminated water fountain constructed in accordance with the foregoing features may be assembled from the modular units according to any desired water discharge pattern, and may also be controlled by musical sounds in accordance with any desired manner as preselected by the preprogrammed element inserted into the holder of the computer.

The source of musical sounds may be a playback unit which plays back pre-recorded music. Alternatively, it may be a microphone which receives live music and controls the illuminated water fountain in accordance therewith.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
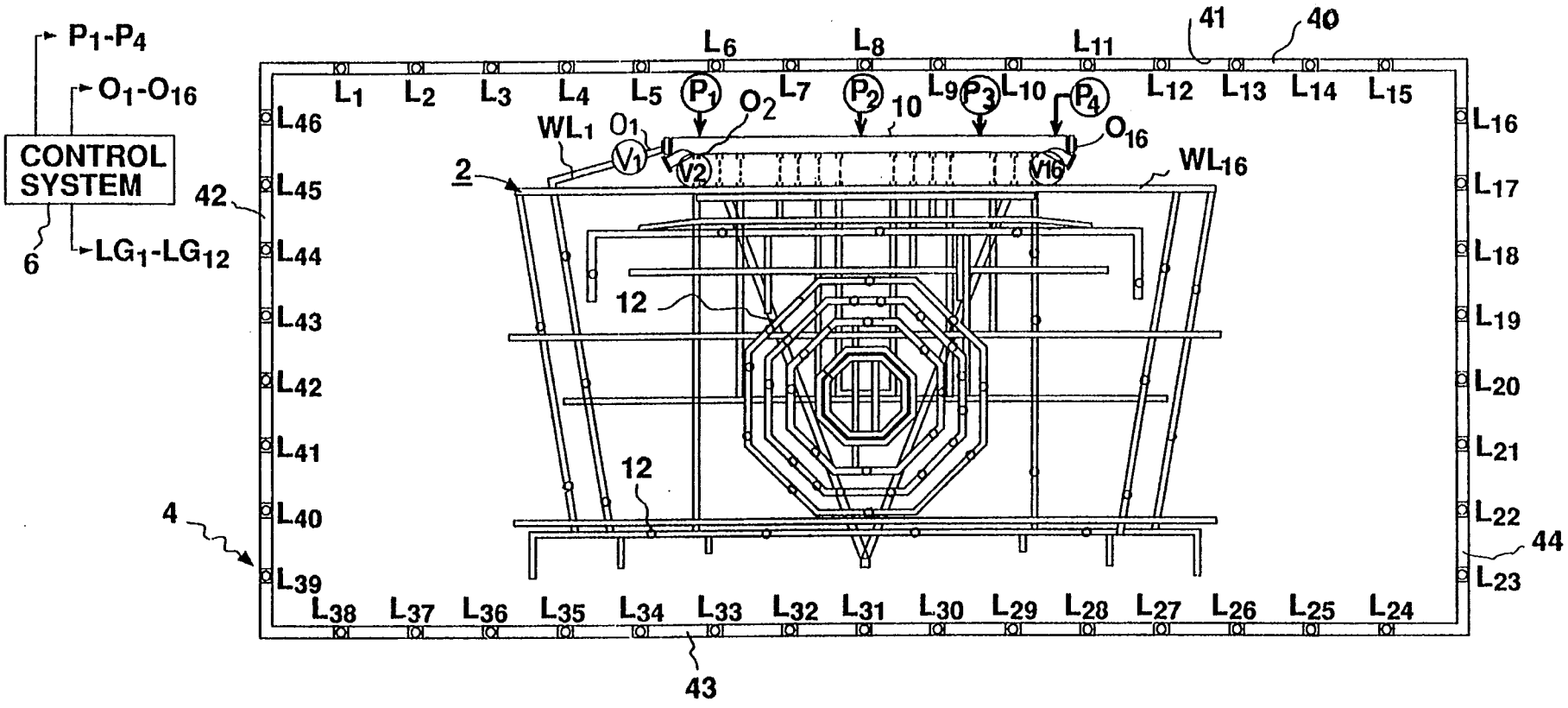
FIG. 1 is a top plan view illustrating one form of illuminated water fountain constructed in accordance with the present invention.
Figure 2:
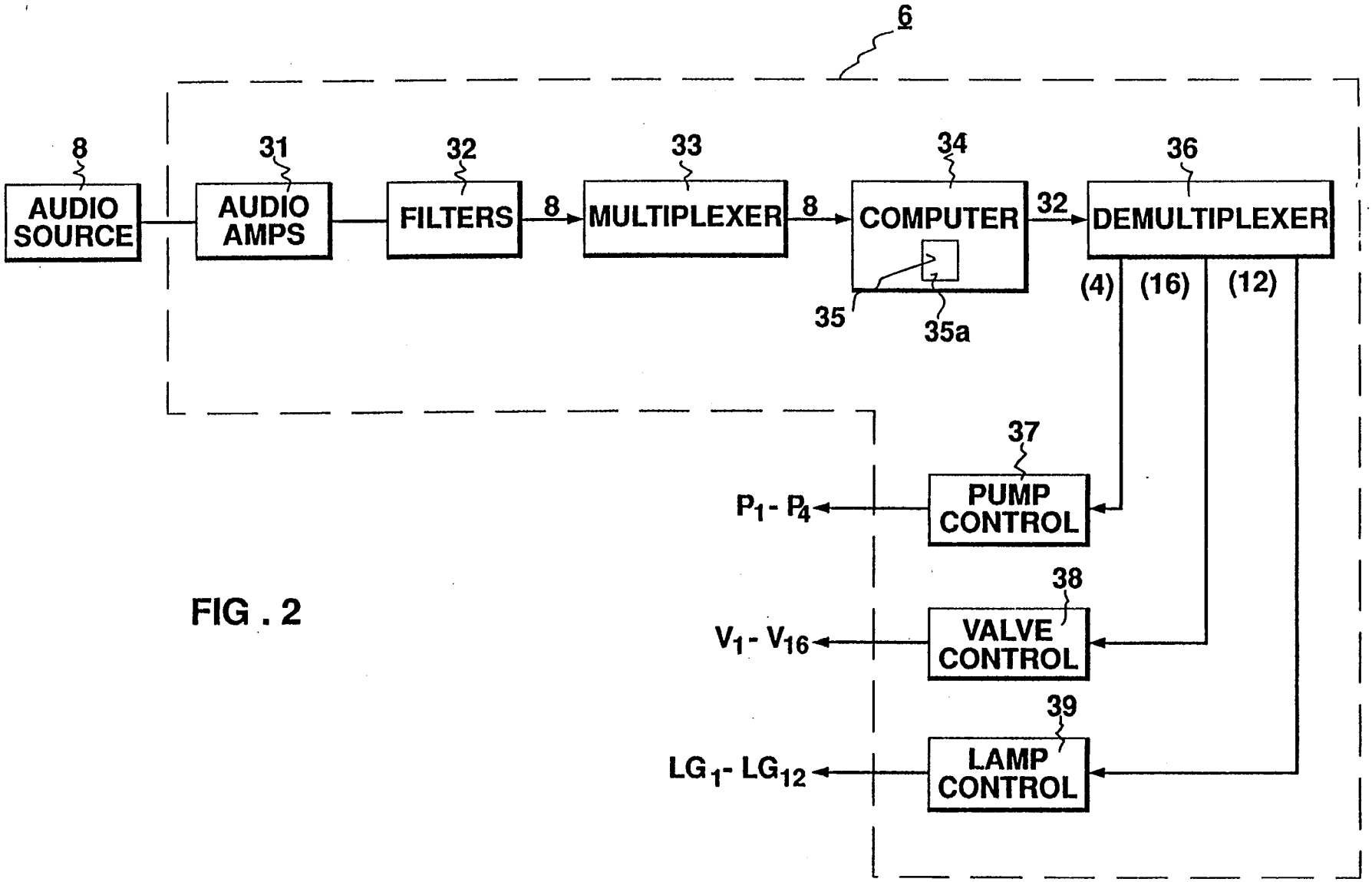
FIG. 2 is a block diagram illustrating the control system for controlling the illuminated water fountain of FIG. 1.

The illuminated water fountain illustrated in the drawings includes an assembly of water lines each carrying a plurality of water discharge nozzles, as illustrated in FIG. 1 and therein generally designated 2, for producing a pattern of water discharges in the form of water jets or spouts; a plurality of pumps $P_1$–$P_4$ for supplying pressurized water to the assembly 2 of water lines; an illumination system, generally designated 4, for illuminating the pattern of water discharges; and a control system, as illustrated in FIG. 2 and therein designated 6, for controlling the water discharge nozzles and also the illumination system to produce various ornamental effects. As will be described below particularly with reference to FIG. 2, the control system includes a source of musical sounds, therein designated 8, for controlling the water discharges from the nozzles in accordance with the musical sounds. The source of musical sounds 8 may be a playback unit for playing back prerecorded music, or may be a microphone which picks up live music, as from a band or orchestra, located at the site of the illuminated water fountain.

The assembly 2 of water lines, as shown in FIG. 1, comprises a distribution manifold 10 having a plurality of input ports, 4 in this case, to the plurality of pumps $P_1$–$P_4$, which supply pressurized water to the distribution manifold. The distribution manifold 10 further includes a plurality of outlet ports, in this case 16 outlet ports identified as $O_1$–$O_{16}$, which supply pressurized water to a plurality of water lines $WL_1$–$WL_{16}$, each under the control of a valve $V_1$–$V_{16}$. Each water line $WL_1$–$WL_{16}$ includes a plurality of discharge nozzles 12 to produce a pattern of upwardly-directed water jets or spouts as known in water fountains of this type.

The water lines $WL_1$–$WL_{16}$ in the assembly 2 illustrated in FIG. 1 are of modular construction. Thus, each water line may be of a different configuration and/or length so as to allow a plurality of such water lines to be assembled to produce any desired water discharge pattern.

For purposes of example, the water line assembly illustrated in FIG. 1 includes 5 water lines each of octogonal shape and of successively decreasing diameter coaxially mounted with respect to each other at the center of the water line assembly. The other water lines $WL_6$–$WL_{16}$ may be disposed according to any desired pattern with respect to the polygonal water line $WL_1$–$WL_5$.

The illumination system 4 illustrated in FIG. 1 includes a rectangular frame 40 constituted of 4 elongated frame members 41–44 enclosing the water line assembly 2. One of the long frame members 41 includes 16 lamps $L_1$–$L_{16}$; the adjacent short frame member 42 includes 8 lamps $L_{17}$–$L_{24}$; the next adjacent long frame member 43 includes 16 lamps $L_{25}$–$L_{40}$; and the next short frame member 44 includes 8 lamps $L_{41}$–$L_{48}$. All 48 lamps $L_1$–$L_{48}$ are equally spaced along the lengths of their respective frame members 41–48.

The 48 lamps $L_1$–$L_{48}$ are arranged in twelve groups $LG_1$–$LG_{12}$ of 4 lamps in each group. All the lamps of one group are the same color, whereas the lamps of different groups are of different colors. In the example illustrated in FIG. 1, the 48 lamps $L_1$–$L_{48}$ are grouped as follows:

Group $LG_1$: lamps $L_{21}$, $L_{22}$, $L_{43}$, $L_{44}$
Group $LG_2$: lamps $L_{25}$, $L_{28}$, $L_{37}$, $L_{40}$
Group $LG_3$: lamps $L_{23}$, $L_{24}$, $L_{41}$, $L_{42}$
Group $LG_4$: lamps $L_5$, $L_{12}$, $L_{20}$, $L_{45}$
Group $LG_5$: lamps $L_6$, $L_{11}$, $L_{19}$, $L_{44}$
Group $LG_6$: lamps $L_4$, $L_{13}$, $L_{17}$, $L_{18}$
Group $LG_7$: lamps $L_{29}$, $L_{30}$, $L_{35}$, $L_{36}$
Group $LG_8$: lamps $L_3$, $L_8$, $L_9$, $L_{14}$
Group $LG_9$: lamps $L_{26}$, $L_{27}$, $L_{38}$, $L_{39}$
Group $LG_{10}$: lamps $L_{31}$, $L_{32}$, $L_{33}$, $L_{34}$
Group $LG_{11}$: lamps $L_1$, $L_2$, $L_{14}$, $L_{15}$
Group $LG_{12}$: lamps $L_7$, $L_{10}$, $L_{18}$, $L_{47}$ Each of the modular water line units $WL_1$–$WL_{16}$ is open at one end, wherein it is connected to the respective outlet ports $O_1$–$O_{16}$ of the distribution manifold 10 via the valves $V_1$–$V_{16}$, and is closed at its opposite end. Thus, all the water inletted into the respective water line is discharged in the form of a plurality of jets or spouts from its respective discharge nozzles 12. Thus, there are no water connections between the water line units except for their connections to the common distribution manifold 10, so that any number of such water line units can be assembled together in a modular fashion as desired. The water line units may be mechanically attached to each other by the use of conventional pipe clamps.

FIG. 2 illustrates the control system, generally designated 6, which controls the 4 pumps $P_1$–$P_4$, the sixteen valves $V_1$–$V_{16}$ between the 16 outlet ports $O_1$–$O_{16}$ of the distribution manifold 10 and the water line units $WL_1$–$WL_{16}$, and the 12 groups $LG_1$–$LG_{12}$ of the 48 lamps $L_1$–$L_{48}$, in accordance with the music from the music source 8. As indicated earlier, the music source may be a playback unit which plays back pre-recorded music, or a microphone which picks up live music from a band or orchestra at the site of the illuminated water fountain.

The control system 6 includes an audio amplifier 31 which receives the musical sounds or signals from audio source 8, and after amplifying them, feeds them to a plurality of filters 32 which separate the sounds into their component frequency bands. For example, there could be 8 filters separating the audio input signal into 8 different frequency bands according to the tone of the music. The filters 32 feed their outputs to an 8-channel muliplexer 33 which converts the 8 parallel inputs to serial outputs before being fed to a computer 34.

Computer 34 includes a holder or slot 35 for receiving a card 35*a*, constituting a preprogrammed element which is programmed to control the water valves $V_1$–$V_{16}$, the lamp groups $LG_1$–$LG_{12}$, and the 4 pumps $P_1$–$P_4$, according to a preselected pattern of water jets and light colors. Thus, if another control pattern of water and lights is desired, it is only necessary to remove the preprogrammed card 35*a* and to substitute another one.

Computer 34 processes the signals inputted from the multiplexer 33 according to the program of the card 35*a*, and outputs 32 signals in serial fashion to 32-channel demultiplexer 36. The demultiplexer outputs 4 of these 32 signals to a pump control unit 37 which controls the pumps $P_1$–$P_4$, 16 signals to a valve control unit 38 which controls the valves $V_1$–$V_{16}$, and 12 signals to a lamp control unit 39 which controls the lamp groups $LG_1$–$LG_{12}$.

While the invention has been described with respect to one preferred embodiment, it will be appreciated that this is set forth merely for purposes of example, and that many other variations, modifications and applications of the invention may be made.

What is claimed is:

1. An illuminated water fountain of modular construction, comprising:

a distribution manifold having a plurality of input ports and a plurality of output ports;

a plurality of pumps connected to said input ports of the distribution manifold;

a plurality of modular water line units connected to said output port of the distribution manifold according to a desired array each water line unit carrying a plurality of water discharge nozzles to produce a desired pattern of water discharges;

each modular water line unit including a valve controlling the supply of water to said nozzles of its respective unit to thereby control the pattern of water discharges thereby;

an illumination system for illuminating the pattern of water discharges;

a source of musical sounds;

and a control system for controlling the water valves and illumination system in accordance with said musical sounds.

2. The illuminated water fountain according to claim 1, wherein said control system includes a converter for converting the musical sounds into control signals corresponding to the different frequencies and intensities of said musical sounds, said control system controlling the water valves and illumination system in accordance with said different frequencies and intensities.

3. The illuminated water fountain according to claim 2, wherein said control system includes a computer controlled by said converter and in turn controlling said water valves and illumination system in accordance with said musical sounds.

4. The illuminated water fountain according to claim 3, wherein said control system further includes a preprogrammed element preprogrammed in accordance with a preselected control of the water valves and illumination system, and a holder for receiving said preprogrammed element in a removable manner permitting its removal and replacement by another preprogrammed element for changing the control of the water valves and illumination system in accordance with said musical sounds.

5. The illuminated water fountain according to claim 1, wherein said illumination system comprises a frame enclosing the assembly of water lines and carrying a plurality of lamps of different colors which may be selectively controlled.

6. The illuminated water fountain according to claim 1, wherein said modular water line units include a plurality of units of the same polygonal configuration but of different sizes enabling a plurality of such units to be assembled coaxially to each other.

7. The illuminated fountain according to claim 1, wherein said illumination system includes a plurality of groups of lamps, each group including a plurality of lamps of the same color.

8. An illuminated water fountain of modular construction, comprising:

a distribution manifold having a plurality of input ports and a plurality of output ports;

a plurality of pumps connected to said input ports of the distribution manifold;

a plurality of modular water line units connected to said output ports of the distribution manifold according to a desired array each water line unit carrying a plurality of water discharge nozzles to produce a desired pattern of water discharges;

each modular water line unit including a valve controlling the supply of water to said nozzles of its respective line to thereby control the pattern of water discharges thereby;

an illumination system for illuminating the pattern of water discharges;

a source of musical sounds;

and a control system for controlling the water valves and illumination system in accordance with said musical sounds;

said control system including a preprogrammed element preprogrammed in accordance with a preselected control of the water valves and illumination system, and a holder for receiving said preprogrammed element in a removable manner permitting its removal and replacement by another preprogrammed element for changing the control of the water valves and illumination system in accordance with said musical sounds.

9. The illuminated water fountain according to claim 8, wherein said control system includes a converter for converting the musical sounds into control signals corresponding to the different frequencies and intensities of said musical sounds, said control system controlling the water valves and illumination system in accordance with said different frequencies and intensities.

10. The illuminated water fountain according to claim 9, wherein said control system includes a computer controlled by said converter and in turn controlling said water valves and illumination system in accordance with said musical sounds.

11. The illuminated water fountain according to claim 8, wherein said illumination system comprises a frame enclosing the assembly of water lines and carrying a plurality of lamps of different colors which may be selectively controlled.

12. The illuminated water fountain according to claim 8, wherein said modular water line units include a plurality of units of the same polygonal configuration but of different sizes enabling a plurality of such units to be assembled coaxially to each other.

13. The illuminated fountain according to claim 8, wherein said illumination system includes a plurality of groups offlamps, each group including a plurality of lamps of the same color.

* * * * *